US010358707B2

(12) United States Patent
Hatano et al.

(10) Patent No.: US 10,358,707 B2
(45) **Date of Patent: *Jul. 23, 2019**

(54) FERRITIC STAINLESS STEEL PLATE WHICH HAS EXCELLENT RIDGING RESISTANCE AND METHOD OF PRODUCTION OF SAME

(71) Applicant: NIPPON STEEL & SUMIKIN STAINLESS STEEL CORPORATION, Tokyo (JP)

(72) Inventors: Masaharu Hatano, Tokyo (JP); Eiichiro Ishimaru, Tokyo (JP); Akihiko Takahashi, Tokyo (JP); Ken Kimura, Tokyo (JP); Shinichi Teraoka, Tokyo (JP)

(73) Assignee: NIPPON STEEL & SUMIKIN STAINLESS STEEL CORPORATION, Tokyo (JP)

( * ) Notice: Subject to any disclaimer, the term of this patent is extended or adjusted under 35 U.S.C. 154(b) by 66 days.

This patent is subject to a terminal disclaimer.

(21) Appl. No.: 15/683,503

(22) Filed: Aug. 22, 2017

(65) Prior Publication Data

US 2017/0349988 A1 Dec. 7, 2017

Related U.S. Application Data

(62) Division of application No. 14/126,083, filed as application No. PCT/JP2012/065507 on Jun. 18, 2012, now Pat. No. 9,771,640.

(30) Foreign Application Priority Data

| | | |
|---|---|---|
| Jun. 16, 2011 | (JP) | 2011-134224 |
| Jun. 16, 2011 | (JP) | 2011-134416 |
| Aug. 5, 2011 | (JP) | 2011-172168 |
| Jun. 14, 2012 | (JP) | 2012-135082 |

(51) Int. Cl.

| | |
|---|---|
| ***C22C 38/44*** | (2006.01) |
| ***C22C 38/54*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/18*** | (2006.01) |
| ***C22C 38/20*** | (2006.01) |
| ***C22C 38/22*** | (2006.01) |
| ***C22C 38/26*** | (2006.01) |
| ***C22C 38/28*** | (2006.01) |
| ***C22C 38/32*** | (2006.01) |
| ***C22C 38/40*** | (2006.01) |

(Continued)

(52) U.S. Cl.

CPC ..... *C22C 38/54* (2013.01); *B21B 1/38* (2013.01); *C21D 6/002* (2013.01); *C21D 8/0226* (2013.01); *C21D 8/0263* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/18* (2013.01); *C22C 38/20* (2013.01); *C22C 38/22* (2013.01); *C22C 38/24* (2013.01); *C22C 38/26* (2013.01); *C22C 38/28* (2013.01); *C22C 38/30* (2013.01); *C22C 38/32* (2013.01); *C22C 38/38* (2013.01); *C22C 38/40* (2013.01); *C22C 38/42* (2013.01); *C22C 38/44* (2013.01); *C22C 38/46* (2013.01); *C22C 38/50* (2013.01); *C21D 2211/005* (2013.01)

(58) Field of Classification Search

CPC ..... C22C 38/008

See application file for complete search history.

(56) References Cited

U.S. PATENT DOCUMENTS

| | | | | |
|---|---|---|---|---|
| 5,851,316 | A | 12/1998 | Yazawa et al. | |
| 6,786,981 | B2 * | 9/2004 | Yazawa | C21D 8/0205 148/325 |

(Continued)

FOREIGN PATENT DOCUMENTS

| | | |
|---|---|---|
| JP | 62-136525 | 6/1987 |
| JP | 63-069921 | 3/1988 |

(Continued)

OTHER PUBLICATIONS

International Search Report dated Sep. 11, 2012, issued in corresponding PCT Application No. PCT/JP2012/065507, with English language translation.

U.S. Advisory Action for U.S. Appl. No. 14/126,083, dated Mar. 29, 2017.

(Continued)

*Primary Examiner* — Jessee R Roe

*Assistant Examiner* — Jophy S. Koshy

(74) *Attorney, Agent, or Firm* — Birch, Stewart, Kolasch & Birch, LLP

(57) ABSTRACT

A Cr-containing ferritic stainless steel sheet is desired with improved corrosion resistance and rust resistance as well as improved ridging resistance. To achieve these results, the ferritic stainless steel sheet derives the relationship between Ap, which shows the γ-phase rate at 1100° C. due to a predetermined ingredient, and Sn in ferritic stainless steel which becomes a dual phase structure of α+γ in the hot rolling temperature region, applies and adds Sn, and hot rolls the steel to give a total rolling rate of 15% or more in 1100° C. or higher hot rolling to thereby obtain ferritic stainless steel sheet which has good ridging resistance, which also has excellent corrosion resistance and rust resistance, and which can be applied to general durable consumer goods, wherein $0.060 \leq Sn \leq 0.634-0.0082Ap$ and $10 \leq Ap \leq 70$.

6 Claims, 1 Drawing Sheet

(51) Int. Cl.

| | |
|---|---|
| ***B21B 1/38*** | (2006.01) |
| ***C22C 38/24*** | (2006.01) |
| ***C22C 38/30*** | (2006.01) |
| ***C22C 38/38*** | (2006.01) |
| ***C22C 38/42*** | (2006.01) |
| ***C22C 38/46*** | (2006.01) |
| ***C22C 38/50*** | (2006.01) |

(56) References Cited

U.S. PATENT DOCUMENTS

| | | | | |
|---|---|---|---|---|
| 8,470,237 | B2 | 6/2013 | Hiraide et al. | |
| 8,721,960 | B2 * | 5/2014 | Hatano | C21D 1/76 148/325 |
| 9,289,964 | B2 * | 3/2016 | Hatano | C22C 38/001 |
| 2002/0117240 | A1 | 8/2002 | Yazawa et al. | |
| 2010/0150770 | A1 | 6/2010 | Hiraide et al. | |
| 2011/0265920 | A1 | 11/2011 | Hatano et al. | |

FOREIGN PATENT DOCUMENTS

| | | |
|---|---|---|
| JP | 05-179358 | 7/1993 |
| JP | 06-081036 | 3/1994 |
| JP | 09-041103 | 2/1997 |
| JP | 11-092872 | 4/1999 |
| JP | 2000-169943 | 6/2000 |
| JP | 2001-288543 | 10/2001 |
| JP | 2001-294991 | 10/2001 |
| JP | 2001-355048 | 12/2001 |
| JP | 2005-220429 | 8/2005 |
| JP | 2010-031315 | 2/2010 |
| JP | 2010-159487 | 7/2010 |
| JP | 2010-215995 | 9/2010 |
| WO | WO 2010/067878 A1 | 6/2010 |

OTHER PUBLICATIONS

U.S. Notice of Allowance for U.S. Appl. No. 14/126,083, dated May 26, 2017.

U.S. Office Action for U.S. Appl. No. 14/126,083, dated Dec. 15, 2016.

U.S. Office Action for U.S. Appl. No. 14/126,083, dated Jun. 16, 2016.

U.S. Restriction Requirement for U.S. Appl. No. 14/126,083, dated Mar. 31, 2016.

* cited by examiner

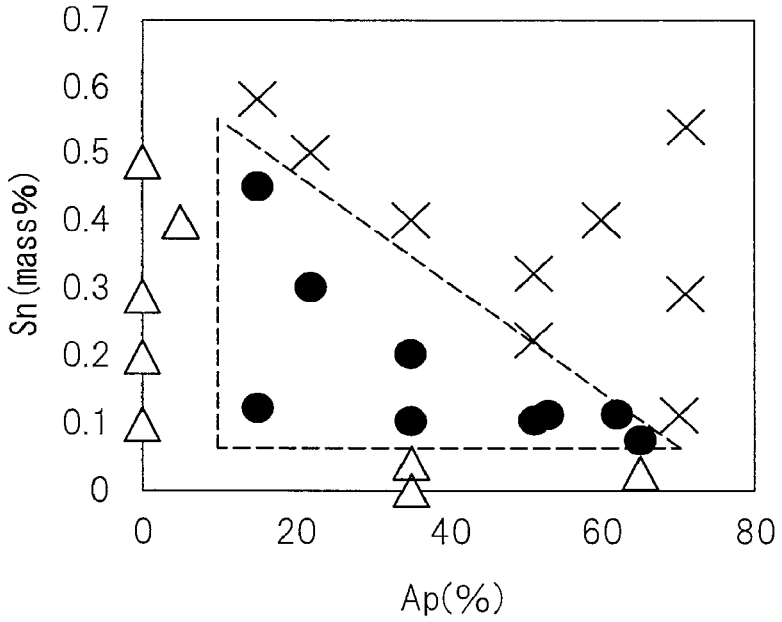
0.7
0.6
0.5
0.4
0.3
0.2
0.1
0
Sn (mass%)
0
20
40
60
80
Ap(%)

FERRITIC STAINLESS STEEL PLATE WHICH HAS EXCELLENT RIDGING RESISTANCE AND METHOD OF PRODUCTION OF SAME

This application is a Divisional of copending application Ser. No. 14/126,083, filed on Dec. 13, 2013, which was filed as PCT International Application No. PCT/JP2012/065507 on Jun. 18, 2012, which claims priority under 35 U.S.C. § 119(a) to Patent Application No. 2011-134224, filed in Japan on Jun. 16, 2011, Patent Application No. 2011-134416, filed in Japan on Jun. 16, 2011, Patent Application No. 2011-172168, filed in Japan on Aug. 5, 2011, and Patent Application No. 2012-135082, filed in Japan on Jun. 14, 2012, all of which are hereby expressly incorporated by reference into the present application.

TECHNICAL FIELD

The present invention relates to ferritic stainless steel sheet which has excellent ridging resistance and a method of production of the same. According to the present invention, since it is possible to provide ferritic stainless steel sheet which has excellent ridging resistance, the conventionally required polishing step etc. can be eliminated and protection of the global environment can be contributed to.

BACKGROUD ART

Ferritic stainless steel such as SUS430 is being broadly used for household electrical appliances, kitchenware, etc. Stainless steel has excellent corrosion resistance as its biggest feature. Therefore, it is also made into products in the form of a base metal without applying any surface treatment.

When shaping ferritic stainless steel, sometimes relief shapes called "ridging" are formed on its surface. If the steel surface suffers from ridging, the beautiful surface appearance will be ruined. Further, polishing for removing the ridging will become necessary. As means for improving the ridging resistance in the type of steel such as the SUS430 which becomes a dual phase of $\alpha+\gamma$ in the hot rolling temperature region, the following techniques are known. (For example, PLTs 1 to 4.)

PLT 1 discloses the technique of prescribing the amount of Al and the amount of N in the steel, bending the steel in the middle of hot rolling, and changing the crystal orientation by subsequent recrystallization. PLT 2 shows the technique of prescribing a compression rate at the time of hot final rolling.

PLT 3 discloses the technique of making the rolling reduction rate per pass 40% or more, giving a large strain, and splitting the ferrite bands. PLT 4 discloses the technique of adjusting the steel to an austenite phase rate which is calculated by the composition of ingredients and prescribing the heating temperature, the final rolling speed, the temperature, etc.

However, with the techniques which are disclosed in PLTs 1, 2, and 4, depending on the type of steel, the ridging resistance is sometimes not necessarily improved. Further, in the technique which is disclosed in PLT 3, sometimes galling defects are formed at the time of rolling. In this case, the productivity falls. In the above way, in steel becoming a dual phase of $\alpha+\gamma$ in the hot rolling temperature region, at the present, no technique has been established for improving the ridging resistance.

On the other hand, in recent years, it has been studied to add a fine amount of Sn to improve the corrosion resistance or high temperature strength of low Cr ferritic stainless steel. (For example, PLTs 5 to 7.) PLT 5 discloses ferritic stainless steel which has a Sn content of less than 0.060%. PLT 6 discloses martensitic stainless steel characterized by an Hv300 or more high hardness. PLT 7 discloses ferritic stainless steel in which Sn is added to improve the high temperature strength.

CITATIONS LIST

Patent Literature

PLT 1: Japanese Patent Publication No. 62-136525A
PLT 2: Japanese Patent Publication No. 63-69921A
PLT 3: Japanese Patent Publication No. 05-179358A
PLT 4: Japanese Patent Publication No. 06-081036A
PLT 5: Japanese Patent Publication No. 11-092872A
PLT 6: Japanese Patent Publication No. 2010-215995A
PLT 7: Japanese Patent Publication No. 2000-169943A

SUMMARY OF INVENTION

Technical Problem

The present invention, in consideration of the above situation, has as its task to improve the ridging resistance in ferritic stainless steel like the SUS430 which becomes a dual phase of $\alpha+\gamma$ in the hot rolling temperature region.

On the other hand, as mentioned above, in Cr ferritic stainless steel, addition of a fine amount of Sn or Mg so as to improve the corrosion resistance is being studied. A certain advantageous effect has been confirmed. However, this has been limited to ferritic stainless steel which has an amount of addition of less than 0.05%. Further, the effect of addition of Sn is manifested in Hv300 or higher martensitic stainless steel or reduced C or N high purity ferritic stainless steel, but at the present a corrosion resistance which is sufficient for expanding the applications has not been obtained.

Therefore, the present invention takes note of Sn and has as its object not only the improvement of the corrosion resistance and rust resistance of Cr ferritic stainless steel and SUS430, but also the ridging resistance and the provision of ferritic stainless steel sheet which can be applied to general durable consumer goods.

Solution to Problem

The inventors worked to solve the above problem by studying in detail the composition of ingredients which leads to ridging resistance of ferritic stainless steel, in particular, the relationship with the content of Sn and the relationship of the manufacturing conditions. As a result, the inventors discovered that in ferritic stainless steel which becomes a dual-phase structure of $\alpha+\gamma$ in the hot rolling temperature region, if adding a suitable quantity of Sn, the ridging resistance can be improved without damaging the manufacturability (hot workability).

The present invention was made based on the above discovery and has as its gist the following:

(1) A ferritic stainless steel sheet which has excellent ridging resistance characterized by comprising, by mass %, C: 0.001 to 0.30%, Si: 0.01 to 1.00%, Mn: 0.01 to 2.00%, P: less than 0.050%, S: 0.020% or less, Cr: 11.0 to 22.0%, N: 0.001 to 0.10%, wherein Ap which is defined by the following (formula 3) satisfies the following (formula 2), a content of Sn satisfies the following (formula 1), residual ingredients are Fe and unavoidable impurities, and the metal structure is a ferrite single phase:

$$0.060 \leq Sn \leq 0.634 - 0.0082\,Ap \quad \text{(formula 1)}$$

$$10 \leq Ap \leq 70 \quad \text{(formula 2)}$$

$$Ap = 420C + 470N + 23Ni + 9Cu + 7Mn - 11.5(Cr + Si) - 12Mo - 52Al - 47Nb - 49Ti + 189 \quad \text{(formula 3)}$$

wherein, each of Sn, C, N, Ni, Cu, Mn, Cr, Si, Mo, Al, Nb, and Ti denotes the content of the element.

(2) A ferritic stainless steel sheet which has excellent ridging resistance characterized by comprising, by mass %, C: 0.001 to 0.30%, Si: 0.01 to 1.00%, Mn: 0.01 to 2.00%, P: less than 0.050%, S: 0.020% or less, Cr: 11.0 to 22.0%, N: 0.001 to 0.10%, wherein Ap which is defined by the (formula 3) satisfies the (formula 2), a content of Sn satisfies the (formula 1), residual ingredients are Fe and unavoidable impurities, by wherein the metal structure is a ferrite single phase, and the ridging height is less than 6 μm. To secure ridging resistance, hot rolling in which the total rolling rate in 1100° C. or higher hot rolling becomes 15% or more is necessary, so the invention of (2) can also be described in the following way:

(2') A ferritic stainless steel sheet which has excellent ridging resistance characterized by heating steel comprising, by mass %, C: 0.001 to 0.30%, Si: 0.01 to 1.00%, Mn: 0.01 to 2.00%, P: less than 0.050%, S: 0.020% or less, Cr: 11.0 to 22.0%, N: 0.001 to 0.10%, wherein Ap which is defined by the (formula 3) satisfying the (formula 2), a content of Sn satisfies the (formula 1), and residual ingredients are Fe and unavoidable impurities, to 1150 to 1280° C. and hot rolling the steel to give a total rolling rate at 1100° C. or higher hot rolling of 15% or more to obtain the steel sheet, the metal structure thereof being a ferrite single phase.

(3) The ferritic stainless steel sheet which has excellent ridging resistance according to (1) or (2) characterized by further comprising, by mass %, one or more elements of Al: 0.0001 to 1.0%, Nb: 0.30% or less, and Ti: 0.30% or less.

(4) The ferritic stainless steel sheet which has excellent ridging resistance according to (1) to (3) characterized by further comprising, by mass %, one or more elements of Ni: 1.0% or less, Cu: 1.0% or less, Mo: 1.0% or less%, V: 1.0% or less, Co: 0.5% or less, and Zr: 0.5% or less.

(5) The ferritic stainless steel sheet which has excellent ridging resistance according to any one of (1) to (4) characterized by further comprising, by mass %, one or more elements of B: 0.005% or less, Mg: 0.005% or less, Ca: 0.005% or less, Y: 0.1% or less, Hf: 0.1% or less, and a REM: 0.1% or less.

(6) A method of production of ferritic stainless steel sheet which has excellent ridging resistance according to any one of (1) to (5) characterized by comprising (i) heating steel of a composition of ingredients according to any one of (1) to (5) to 1150 to 1280° C. and hot rolling the steel to give a total rolling rate at 1100° C. or higher hot rolling of 15% or more to obtain a hot rolled steel sheet and (ii) coiling the hot rolled steel sheet, annealing the hot rolled steel sheet or not annealing the hot rolled steel sheet, cold rolling the rolled steel sheet, and annealing the rolled steel sheet.

(7) A ferritic stainless steel sheet which has excellent hot workability and rust resistance characterized comprising, by mass %, C: 0.001 to 0.3%, Si: 0.01 to 1.0%, Mn: 0.01 to 2.0%, P: 0.005 to 0.05%, S: 0.0001 to 0.01%, Cr: 11 to 13%, N: 0.001 to 0.1%, Al: 0.0001 to 1.0%, Sn: 0.06 to 1.0%, and a balance of Fe and unavoidable impurities, wherein the metal structure of the stainless steel sheet is a ferrite single phase, and wherein γp which is defined by the following formula (formula 3-2) satisfies the following formula (formula 3-1).

$$10 \leq \gamma p \leq 65 \quad \text{(formula 3-1)}$$

$$\gamma p = 420C + 470N + 23Ni + 7Mn + 9Cu - 11.5Cr - 11.5Si - 52Al - 69Sn + 189 \quad \text{(formula 3-2)}$$

wherein, each of C, N, Ni, Mn, Cu, Cr, Si, Al, and Sn denotes the content of the element (8) The ferritic stainless steel sheet which has excellent hot workability and rust resistance according to (7) characterized by satisfying, instead of the formula (formula 3-1), the following formula (formula 3-1'):

$$15 \leq \gamma p \leq 55 \quad \text{(formula 3-1')}$$

(9) A ferritic stainless steel sheet which has excellent hot workability and rust resistance comprised of, by mass %, C: 0.001 to 0.3%, Si: 0.01 to 1.0%, Mn: 0.01 to 2.0%, P: 0.005 to 0.05%, S: 0.0001 to 0.02%, Cr: over 13 to 22%, N: 0.001 to 0.1%, Al: 0.0001 to 1.0%, Sn: 0.060 to 1.0%, and a balance of Fe and unavoidable impurities, wherein the metal structure of the stainless steel sheet is a ferrite single phase, and wherein γp which is defined by the following formula (formula 2-2) satisfies the following formula (formula 2-1).

$$5 \leq \gamma p \leq 55 \quad \text{(formula 2-1)}$$

$$\gamma p = 420C + 470N + 23Ni + 7Mn + 9Cu - 11.5Cr - 11.5Si - 52Al - 57.5Sn + 189 \quad \text{(formula 2-2)}$$

wherein, each of C, N, Ni, Mn, Cu, Cr, Si, Al, and Sn denotes the content of the element.

(10) The ferritic stainless steel sheet which has excellent hot workability and rust resistance according to (9) characterized by satisfying, instead of the formula (formula 2-1), the following formula (formula 2-1'):

$$10 \leq \gamma p \leq 40 \quad \text{(formula 2-1')}$$

(11) The ferritic stainless steel sheet which has excellent hot workability and rust resistance according to (7) to (10) characterized in that the ferritic stainless steel sheet further contains, by mass %, one or more elements of Mg: 0.005% or less, B: 0.005% or less, Ca: 0.005% or less, La: 0.1% or less, Y: 0.1% or less, Hf: 0.1% or less, and a REM: 0.1% or less.

(12) The ferritic stainless steel sheet which has excellent hot workability and rust resistance according to any one of (7) to (11) characterized by further comprising, by mass %, one or more elements of Nb: 0.3% or less, Ti: 0.3% or less, Ni: 1.0% or less, Cu: 1.0% or less, Mo: 1.0% or less, V: 1.0% or less, Zr: 0.5% or less, and Co: 0.5% or less.

(13) A method of production of ferritic stainless steel sheet which has excellent hot workability and rust resistance characterized by comprising heating a stainless steel slab having a composition of ingredients according to any one of (7) to (12) to 1100 to 1300° C. and hot rolling the stainless steel slab to give a total rolling rate at 1100° C. or higher hot rolling of 15% or more to obtain a stainless steel sheet, and coiling the stainless steel sheet at 700 to 1000° C. after finishing hot rolling.

(14) The method of production of ferritic stainless steel sheet which has excellent hot workability and rust resistance according to (13) characterized by, after finishing hot rolling, not comprising annealing the steel sheet or comprising annealing the steel sheet at 700 to 1000° C. by continuous annealing or box annealing.

Advantageous Effects of Invention

According to the present invention, it is possible to provide ferritic stainless steel sheet which has excellent ridging resistance, rust resistance, and workability without relying on use of rare metals by effectively utilizing the Sn in recycled sources of iron.

BRIEF DESCRIPTION OF DRAWINGS

FIG. 1 is a view which shows the relationship among Ap and the amount of Sn, the ridging resistance, and the presence of edge cracking in the hot rolled steel sheet.

DESCRIPTION OF EMBODIMENTS

Below, the present invention will be explained in detail.

[First Embodiment: Explanation of Steel Sheet of Present Invention Providing Improvement of Ridging Resistance]

First, in the steel sheet according to the present invention, a first embodiment of ferritic stainless steel sheet which has excellent ridging resistance, rust resistance, and hot workability (below, also sometimes referred to as the "present invention steel sheet providing the ridging resistance") will be explained. The ferritic stainless steel sheet which has excellent ridging resistance of this aspect of the present invention (steel sheet of present invention providing the ridging resistance) is characterized by comprising, by mass %, C: 0.001 to 0.30%, Si: 0.01 to 1.00%, Mn: 0.01 to 2.00%, P: less than 0.050%, S: 0.020% or less, Cr: 11.0 to 22.0%, N: 0.0010 to 0.10%, wherein an Ap which is defined by (formula 3) satisfies (formula 2), a content of Sn satisfying (formula 1), residual ingredients are Fe and unavoidable impurities, and the metal structure being a ferrite single phase:

$$0.060 \leq Sn \leq 0.634 - 0.0082\,Ap \quad \text{(formula 1)}$$

$$10 \leq Ap \leq 70 \quad \text{(formula 2)}$$

$$Ap = 420C + 470N + 23Ni + 9Cu + 7Mn - 11.5(Cr+Si) - 12Mo - 52Al - 47Nb - 49Ti + 189 \quad \text{(formula 3)}$$

wherein, each of Sn, C, N, Ni, Cu, Mn, Cr, Si, Mo, Al, Nb, and Ti denotes the content of the element (mass %).

Ap is the γ-phase rate which is calculated from the above contents of the elements (mass %) and is an indicator which shows the maximum value of the amount of austenite which is formed when heating to 1100° C. The coefficients of the elements are the extents of contribution to the formation of the γ-phase as determined experimentally. Note, elements which are not present in the steel are indicated as 0% for calculation of the above (formula 3).

First, the experiments which led to the finding serving as the basis of the present invention to be obtained and the results thereof will be explained. The inventors used SUS430 for the basic ingredients, changed the composition of ingredients to produce and cast several dozen or so types of stainless steel, and hot rolled the cast slabs while changing the hot rolling conditions to obtain hot rolled steel sheets. Furthermore, they annealed the hot rolled steel sheets, or did not anneal them, cold rolled them, then annealed them, to obtain the finished sheets.

From the finished sheets, JIS No. 5 tensile test pieces were taken. Each was given a 15% tensile strain in parallel to the rolling direction and was measured for relief height at the sheet surface after being given the tensile strain so as to thereby evaluate the ridging resistance. The case where the relief height was less than 6 μm was defined as a "good" ridging resistance. From the test results, the inventors obtained the following discoveries.

(w) The ridging resistance of the type of steel to which Sn is added is sometimes dramatically improved compared with the ridging resistance of the type of steel to which Sn is not added. This effect of improvement of the ridging resistance is remarkable in the case where the structure is a dual phase structure of α+γ in the hot rolling temperature region.

(x) To obtain the effect of improvement of the ridging resistance by the addition of Sn, the heating conditions of the steel slab before hot rolling are important. In particular, if the temperature of the initial stage of hot rolling is too low, the ridging resistance is not improved. On the other hand, if the temperature of the initial stage of hot rolling is too high, at the time of hot rolling, defects are formed at the steel sheet surface. For this reason, there is a suitable range of the heating temperature of a steel slab before hot rolling.

(y) Further, the rolling conditions of the initial stage of hot rolling also greatly influence the ridging resistance. Specifically, when the total rolling reduction rate from the start of hot rolling until reaching 1100° C. is high, the effect of improvement of the ridging resistance is remarkable.

(z) If the amount of Sn addition is too great, edge cracking occurs at the time of hot rolling and the manufacture itself of the hot rolled steel sheet becomes difficult.

The inventors used SUS430 for the basic steel and changed the amount of Sn to adjust the Ap which was defined by the above (formula 3). They heated each steel material to 1200° C. and made the total rolling reduction rate at 1100° C. or higher 15% or more to produce the hot rolled steel sheet and inspect for the presence of edge cracking.

Further, they heat treated each hot rolled steel sheet at about 820° C. for 6 hours or more to cause it to recrystallize, then cold rolled it and further recrystallized and annealed it. From the obtained steel sheet, they obtained a JIS No. 5 tensile test piece, imparted 15% tensile strain parallel to the rolling direction, and measured the relief height at the steel sheet surface after imparting tensile strain.

FIG. 1 shows the relationship between the Ap and the amount of Sn, ridging resistance, and presence of edge cracking at the hot rolled steel sheet. The notations in the figure indicate the following:

x (poor): edge cracking occurs at the time of hot rolling

Δ (fair): edge cracking does not occur at the time of hot rolling, but ridging resistance is poor ● (good): edge cracking does not occur at the time of hot rolling, and ridging resistance is good From FIG. 1, it will be understood that when the amount of Sn addition is high and Ap (γ-phase rate in steel) is high, edge cracking easily occurs due to hot rolling. Further, from FIG. 1, it will be understood that if the amount of Sn satisfies the above (formula 1) and Ap (γ-phase rate) satisfies the above (formula 2), an excellent ridging resistance is obtained.

Next, the reasons for limiting the composition of ingredients of the present invention steel sheet providing the ridging resistance will be explained. Below, the % according to the composition of ingredients means mass %.

C: C is an austenite-forming element. A large amount of addition increases the γ-phase rate and, further, leads to deterioration of the hot workability, so the upper limit is made 0.30%. However, excessive reduction leads to an increase in the refining costs, so the lower limit is made 0.001%. If considering the refining costs and the manufacturability, making the lower limit 0.01%, further 0.02%, is preferable, while making the upper limit 0.10%, further 0.07%, is preferable.

Si: Si is an element which is effective for deoxidation and, further, which is effective for improvement of the oxidation resistance. To obtain the effect of addition, 0.01% or more is added, but a large amount of addition leads to a drop in the workability, so the upper limit is made 1.00%. On the point of achieving both workability and manufacturability, the lower limit is preferably made 0.10%, more preferably 0.12%, while the upper limit is preferably made 0.60%, more preferably 0.45%.

Mn: Mn is an element which forms sulfides and thereby lowers the corrosion resistance. For this reason, the upper limit is made 2.00%. However, excessive reduction leads to an increase in the refining costs, so the lower limit is made 0.01%. If considering the manufacturability, the lower limit is preferably made 0.08%, more preferably 0.12%, still more preferably 0.15%, while the upper limit is preferably made 1.60%, more preferably 0.60%, still more preferably 0.50%.

P: P is an element which causes the manufacturability and the weldability to deteriorate. For this reason, this is an unavoidable impurity for which less is best, but the upper limit is made 0.05%. More preferably, it should be made 0.04% or less, still more preferably 0.03% or less. Excessive reduction leads to an increase in the cost of the materials etc., so the lower limit may be set to 0.005%. Further, it may be made 0.01%.

S: S is an element which causes the hot workability and the rust resistance to deteriorate. For this reason, this is an unavoidable impurity for which less is best, but the upper limit is made 0.02%. More preferably, it should be made 0.01% or less, still more preferably 0.005% or less. Excessive reduction leads to an increase in the manufacturing costs, so the lower limit may be set to 0.0001%, preferably 0.0002%, more preferably 0.0003%, still more preferably 0.0005%.

Cr: Cr is a main element of ferritic stainless steel and is an element which improves the corrosion resistance. To obtain the effect of addition, 11.0% or more is added. However, a large amount of addition invites deterioration of the manufacturability, so the upper limit is made 22.0%. If considering obtaining a corrosion resistance of the level of SUS430, the lower limit is preferably 13.0%, more preferably 13.5%, still more preferably 14.5%. From the viewpoint of securing the manufacturability, the upper limit may be made 18.0%, preferably 16.0%, more preferably 16.0%, still more preferably 15.5%.

N: N, like C, is an austenite-forming element. A large amount of addition increases the γ-phase rate and still further leads to deterioration of the hot workability, so the upper limit is made 0.10%. However, excessive reduction leads to an increase in the refining costs, so the lower limit is made 0.001%. If considering the refining cost and the manufacturability, preferably the lower limit may be made 0.01%, while the upper limit may be made 0.05%.

Sn: Sn is an element which is essential for improving the ridging resistance in the present invention steel. Further, Sn is also an element which is essential for securing the targeted rust resistance without relying on Cr, Ni, Mo, and other rare metals. Further, Sn acts as a ferrite forming element and suppresses the formation of the austenite. Due to its inoculation effect, there is also the effect of refining the solidified structure. For this reason, the season cracking of the steel ingot which used to occur when the Ap was small can be alleviated by refining the solidified structure by the addition of Sn.

In the present invention steel, to obtain the targeted rust resistance and ridging resistance, 0.05% or more should be added. From the viewpoint of making the ridging resistance improvement effect reliable, the lower limit is preferably made 0.060%. Furthermore, if considering the economy and manufacturing stability, over 0.100% is preferable, while over 0.150% is more preferable.

The greater the amount of Sn, the better the rust resistance and the ridging resistance, but a large amount of addition invites deterioration of the hot workability. The inventors, as explained above, discovered regarding the ridging resistance that there is a strong relationship between the amount of addition of Sn and the Ap (γ-phase rate in steel) (FIG. 1). From FIG. 1, it will be understood that when the amount of Sn addition is high and the Ap (γ-phase rate in steel) is high, edge cracking easily occurs in hot rolling. Further, from FIG. 1, it will be understood that if the amount of Sn satisfies the above (formula 1) and Ap (γ-phase rate) satisfies the above (formula 2), an excellent ridging resistance is obtained. From this discoveries, the upper limit of Sn is prescribed by the following (formula 1') which is obtained from the test results which are shown in FIG. 1.

$$Sn \leq 0.63 - 0.0082\,Ap \qquad \text{(formula 1')}$$

That is, the upper limit of Sn changes due to the austenite potential Ap (γ-phase rate). If Sn>0.63−0.0082Ap, the hot workability of the steel deteriorates and, at the time of hot rolling, edge cracking remarkably occurs.

Al, Nb, Ti: Al, Nb, and Ti are elements which are effective for improving the workability. One type or two or more types are added in accordance with need.

Al, in the same way as Si, is an element which is effective for deoxidation and which improves the rust resistance. To obtain the effect of addition, 0.0001% or more should be added. If considering the effect of addition, the lower limit is preferably 0.001% more preferably 0.005%, still more preferably 0.01%. However, excessive addition invites a drop the toughness or weldability, so the upper limit is made 1.0%. Considering securing the toughness and the weldability, the upper limit is preferably 0.5%, more preferably 0.15%, still more preferably 0.10%.

Nb and Ti, if added in large amounts, invite saturation of the effect of improvement of workability and, further, hardening of the steel material, so the upper limits of Nb and Ti should be made 0.30% or less, preferably 0.1%, more preferably 0.08%. On the other hand, to obtain the effect of addition, preferably 0.03 or more may be respectively added, more preferably 0.04% or more, still more preferably 0.05% or more.

Ni, Cu, Mo, V, Zr, and Co: Ni, Cu, Mo, V, Zr, and Co are elements which are effective for improving the corrosion resistance. However, large amounts of addition cause the workability to deteriorate, so the upper limits of Ni, Cu, Mo, and V are made 1.0%. From the viwpoint of the workability, the upper limits are preferably 0.30%, more preferably 0.25%.

One type or two or more types are added in accordance with need, but to obtain the effect of addition, any of Ni, Cu, Mo, and V may be added in 0.01% or more. Zr and Co may similarly be added in 0.01% or more. To stably obtain the corrosion resistance improvement effect, the lower limits are preferably 0.05%, more preferably 0.1%. To stably obtain the corrosion resistance improvement effect, any of Ni, Cu, Mo, V, Zr, and Co is preferably over 0.05% to 0.25%, more preferably 0.1 to 0.25%.

B, Mg, Ca: B, Mg, and Ca are elements which refine the solidified structure and improve the ridging resistance. Large amounts of addition invite deterioration of the workability and corrosion resistance, so in each case the upper limit is made 0.005%. From the viewpoint of the workability, the upper limit is preferably 0.0030%, more preferably 0.0025%, still more preferably 0.002%.

One type or two or more types are added in accordance with need, but to obtain the effect of addition, B: 0.0003% or more may be added, Mg: 0.0001% or more may be added, and Ca: 0.0003% or more may be added. From the viewpoint of the effect of addition, the lower limits are preferably 0.0005%, more preferably 0.0007%, still more preferably 0.0008%.

However, in addition, La, Y, Hf, and REM are elements which raise the hot workability and the cleanliness of steel and which remarkably improve the rust resistance and the hot workability. Excessive addition leads to a rise in alloy costs and a drop in the manufacturability. In each case, the upper limit is made 0.1%. Preferably, considering the effect of addition, economy, and manufacturability, for one type or two or more types in total, the lower limit may be made 0.001%, while the upper limit may be made 0.05%. If added, in accordance with need, in each case, 0.001% or more may be added.

The metal structure of the steel sheet of the present invention providing the ridging resistance is a ferrite single phase. No austenite phase or martensite phase or other phases is included. Even if carbides, nitrides, and other precipitates are mixed in, the ridging resistance and the hot workability are not greatly affected, so these precipitates may be present to an extent not impairing the properties of the steel sheet of the present invention providing the ridging resistance.

The Ap at the right side "0.63−0.0082 Ap" of the (formula 1') which prescribes the upper limit of the amount of Sn has to satisfy $10 \leq Ap \leq 70$ (see FIG. 1).

If Ap is less than 10, even if adding Sn, the ridging resistance is not improved. The larger the Ap, the better the ridging resistance, but if over 70, the hot workability remarkably deteriorates, so 70 is made the upper limit. If considering the stable manufacture of steel sheet of the present invention providing the ridging resistance, Ap is preferably 20 to 50.

Next, the method of manufacture of the steel sheet of the present invention providing the ridging resistance will be explained. The method of manufacture of the steel sheet of the present invention providing the ridging resistance is characterized by (i) heating steel of the required composition of ingredients to 1150 to 1280° C. and hot rolling that steel to give a total rolling rate at 1100° C. or higher hot rolling of 15% or more so as to obtain hot rolled steel sheet and (ii) coiling the above hot rolled steel sheet, then annealing that hot rolled steel sheet or not annealing it, but cold rolling and then annealing it.

Here, the reasons for limitation of the manufacturing conditions in the method of production of the steel sheet of the present invention providing the ridging resistance will be explained. When hot rolling a cast slab of ferritic stainless steel, the cast slab is heated to 1150 to 1280° C. before hot rolling. If the heating temperature is less than 1150° C., it becomes difficult to secure the total rolling rate of 15% or more at the 1100° C. or higher hot rolling. Further, during hot rolling, edge cracking occurs at the hot rolled steel sheet. On the other hand, if the heating temperature exceeds 1280° C., the crystal grains of the cast slab surface layer grow and defects are sometimes formed at the hot rolled steel sheet at the time of hot rolling.

In the method of production of the steel sheet of the present invention providing the ridging resistance, the total rolling rate in the 1100° C. or higher hot rolling is made 15% or more. Due to this, the ridging resistance can be remarkably improved. This point is the greatest feature in the method of production of the steel sheet of the present invention providing the ridging resistance.

The reason why making the total rolling rate 15% or more in the 1100° C. or higher hot rolling enables a remarkable improvement in the ridging resistance of the final sheet is not clear, but is believed to be as follows based on results of tests up to now.

In SUS430, 1100° C. is the temperature where the γ-phase rate becomes the greatest. In the region of a temperature higher than 1100° C., the hot rolled steel sheet is given strain, then the hot rolled steel sheet falls in temperature to 1100° C. In the process, the strain acts as nuclei for formation of the γ-phase and the γ-phase is finely formed. At this time, the Sn which concentrates at the γ- and α-grain boundaries causes a delay in formation of the γ-phase from the grain boundaries. As a result, formation of the γ-phase in the α-grains is promoted.

Due to the presence of the γ-phase which is finely formed in this way, in the subsequent hot rolling, the coarse ferrite phase, which is the cause of formation of ridging, is finely split. In the past, recrystallization of the α-phase said to be effective for improvement of the ridging resistance is suppressed by addition of Sn.

After the hot rolling, as usual, the hot rolled steel sheet is coiled up. As explained above, at the initial stage of hot rolling (hot rolling at 1100° C. or more), the coarse ferrite grains which influence the ridging resistance are split, so there is little effect on the steps from the final rolling and on. Therefore, the coiling temperature does not particularly have to be prescribed.

The hot rolled steel sheet may be annealed or not annealed. When annealing the hot rolled steel sheet, either box annealing or annealing by a continuous line is possible. Whichever annealing is applied, there is an effect of improvement of the ridging resistance. Next, the hot rolled steel sheet is cold rolled and annealed. The cold rolling may be performed two times or may be performed three times. After the last annealing, the sheet may be pickled and temper rolled.

EXAMPLES

Next, examples of the present invention will be explained, but the conditions of the examples are just illustrations which are employed for confirming the workability and advantageous effect of the present invention. The present invention is not limited to these illustrations of conditions. The present invention may employ various conditions so far as not departing from the gist of the present invention and achieving the object of the present invention.

Example 1

Ferritic stainless steels having the compositions of ingredients shown in Table 1 were produced. From the steel ingots, steel slabs of thicknesses of 70 mm were taken and hot rolled under various conditions to roll them down to thicknesses of 4.5 mm. The hot rolled steel sheets were inspected for the presence of any edge cracking. Further, the hot rolled steel sheets were pickled, then visually inspected for the presence of any surface defects.

The obtained hot rolled steel sheets were annealed, or not annealed, then cold rolled, then annealed so as to produce sheet products of thicknesses of 1 mm. The final annealing temperatures were adjusted so that all of the sheet products became recrystallized structures. From the obtained sheet products, JIS No. 5 tensile test pieces were obtained. These were given 15% tensile strain in the rolling direction.

After applying tension, a roughness meter was used to scan the surface in the rolling direction and the direction vertical to the same so as to measure the heights of the ridging (surface relief). The method of measuring the ridging was as follows:

The center part of the parallel part of a test piece given 15% tension in the rolling direction was scanned in the rolling direction and a vertical direction to the same by a contact type roughness meter so as to obtain the relief profile. At that time, the measurement length was set to 10 mm, the measurement speed to 0.3 mm/s, and the cutoff to 0.8 mm. From the relief profile, the length in the depth direction of a recessed part which is formed between one projecting part and another projecting part was defined as the ridging height and measured. The ridging rank was defined by the height of the ridging as follows: AA: less than 3 μm, A: less than 6 μm, B: 6 μm to less than 20 μm, C: 20 μm or more. With the usual production process, the ridging rank is B to C.

The hot rolling conditions, presence of any edge cracking, presence of hot rolling defects, and ridging rank are shown in Tables 2 (Table 2-1 and Table 2-2 are together referred to as "Tables 2"). The invention examples were all free of occurrence of edge cracking and hot rolling defects and had ridging ranks of AA or A.

Comparative Example 3, 29, and 38 are test examples relating to ferritic stainless steel sheets which have the composition of ingredients and Ap of the present invention, but are manufactured by manufacturing conditions which deviate from the manufacturing conditions of the present invention. The heating temperatures before hot rolling deviate from the upper limit of the range of the present invention. In these steel sheets, the hot workabilities are excellent, but surface defects occur at the hot rolled steel sheets, the ridging resistances are the rank B, and the target characteristics are not obtained.

Comparative Examples 1, 4, 7, 8, 11, 14, 15, 16, 18, 20, 21, 23, 24, 27, 31, 34, 41, 44, 62, 63, 65, 67, 68, 71, 74, 77, and 78 are test examples relating to ferritic stainless steel sheets which have the composition of ingredients and Ap of the present invention, but are manufactured by manufacturing conditions which deviate from the manufacturing conditions of the present invention. In these steel sheets, the hot workabilities are excellent, but the target ridging resistances are not obtained.

Comparative Examples 7, 15, 21, 34, 44, 62, 65, 68, 71, 74, and 78 have heating temperatures before hot rolling which are outside the lower limit of the range of the present invention and have total rolling rates in 1100° C. or higher hot rolling which are less than 15%, and have ranks of ridging resistance of C (Comparative Examples 15 and 78, ranks B).

Comparative Examples 1, 4, 8, 11, 14, 16, 18, 20, 23, 24, 27, 31, 41, 63, 67, and 77 have heating temperatures before hot rolling which are inside the range of the present invention, but have total rolling rates in 1100° C. or higher hot rolling which are less than 15% and have ranks of ridging resistance of (Comparative Example 77, rank B). Comparative Examples 39 and 46 to 54 have compositions of ingredients which are outside the compositions of ingredients of the present invention, so even if the manufacturing conditions are within the range of the present invention, the target ridging resistance is not obtained.

Comparative Examples 55 to 60 have Ap's outside the range of the present invention, so even if the manufacturing conditions are within the range of the present invention, the target ridging resistance is not obtained.

[Second Embodiment: Explanation of Steel Sheet of Present Invention Providing Improvement of Rust Resistance]

Next, in the steel sheets according to the present invention, a second embodiment of ferritic stainless steel sheet which has excellent hot workability and rust resistance (below, also sometimes referred to as "the steel sheet of the present invention providing the rust resistance") will be explained. The inventors obtained the discoveries of the following (a) to (e) from the viewpoint of the rust resistance and workability.

(a) Sn is an element which is effective for improvement of the rust resistance of high purity ferritic stainless steel, but the invention is not limited to high purity ferritic stainless steel. In Cr ferritic stainless steel as well, the fact that the rust resistance is improved by the addition of a fine amount of Sn was confirmed. Further, the extent of contribution to the formation of the γ-phase, in the same way as with the above-mentioned Ap, is the γ-phase rate which is calculated from the contents of the above elements (mass %) and can be evaluated by an indicator which shows the maximum value of the amount of austenite which is formed at the time of heating to 1100° C. At this time, it was confirmed experimentally that the amount of addition of Sn can be incorporate in the γ-phase rate formula.

Further, it was learned that at an amount of addition of Cr of 13%, the behavior differed somewhat. That is, in medium Cr ferritic stainless steel where the amount of addition of Cr is over 13%, if adjusting the γp(H) which is defined by the following formulas to 5γp(H)≤55, a good hot workability can be obtained.

$$5 \leq \gamma p(\mathrm{H}) \leq 55 \quad \text{(formula 2-1)}$$

$$\gamma p(\mathrm{H}) = 420\mathrm{C} + 470\mathrm{N} + 23\mathrm{Ni} + 7\mathrm{Mn} + 9\mathrm{Cu} - 11.5\mathrm{Cr} - 11.5\mathrm{Si} - 52\mathrm{Al} - 57.5\mathrm{Sn} + 189 \quad \text{(formula 2-2)}$$

γp(H) is an indicator which expresses the maximum value of the amount of austenite which is formed when heating at 1100° C.

In low Cr ferritic stainless steel where the amount of addition of Cr is 13% or less, if adjusting the γp(L) which is defined by the following formulas to 10≤γp(L)≤65, good hot workability can be obtained.

$$10 \leq \gamma p(\mathrm{L}) \leq 65 \quad \text{(formula 3-1)}$$

$$\gamma p(L) = 420\mathrm{C} + 470\mathrm{N} + 23\mathrm{Ni} + 7\mathrm{Mn} + 9\mathrm{Cu} - 11.5\mathrm{Cr} - 11.5\mathrm{Si} - 52\mathrm{Al} - 69\mathrm{Sn} + 189 \quad \text{(formula 3-2)}$$

γp(L), like γp(H), is an indicator which expresses the maximum value of the amount of austenite which is formed when heating at 1100° C.

(b) The hot workability can be improved by lowering the C or N to lower the deformation resistance at a high temperature or by adding fine amounts of Mg, B, Ca, etc. to raise the intergranular strength.

(c) Further, the hot workability can be improved by raising the slab heating temperature and the hot rolling end temperature to reduce the deformation resistance at a high temperature.

(d) The rust resistance can be improved by adding the stabilizing elements of Nb and Ti or by the entry of Ni, Cu, Mo, V, etc. from recycled sources of iron.

That is, the gist of the steel sheet of the present invention for medium Cr ferritic stainless steel providing the rust resistance is as follows:

(2-1) Ferritic stainless steel sheet which has excellent hot workability and rust resistance which contains, by mass %, C: 0.001 to 0.3%, Si: 0.01 to 1.0%, Mn: 0.01 to 2.0%, P: 0.005 to 0.05%, S: 0.0001 to 0.02%, Cr: over 13.0 to 22.0%, N: 0.001 to 0.1%, Al: 0.0001 to 1.0%, Sn: 0.060 to 1.0%, and a balance of Fe and unavoidable impurities, the ferritic stainless steel sheet characterized by having an γp(H), which is defined by (formula 2-2), satisfying following (formula 2-1).

$$5 \leq \gamma p(\mathrm{H}) \leq 55 \quad \text{(formula 2-1)}$$

$$\gamma p(\mathrm{H}) = 420\mathrm{C} + 470\mathrm{N} + 23\mathrm{Ni} + 7\mathrm{Mn} + 9\mathrm{Cu} - 11.5\mathrm{Cr} - 11.5\mathrm{Si} - 52\mathrm{Al} - 57.5\mathrm{Sn} + 189 \quad \text{(formula 2-2)}$$

wherein, each of C, N, Ni, Mn, Cu, Cr, Si, Al, and Sn denotes the content of the element. Alternatively, the gist of the steel sheet of the present invention for low Cr ferritic stainless steel providing the rust resistance is as follows:

(2-2) Ferritic stainless steel sheet which has excellent hot workability and rust resistance which contains, by mass %, C: 0.001 to 0.3%, Si: 0.01 to 1.0%, Mn: 0.01 to 2.0%, P: 0.005 to 0.05%, S: 0.0001 to 0.01%, Cr: 11.0 to 13.0%, N: 0.001 to 0.1%, Al: 0.0001 to 1.0%, Sn: 0.060 to 1.0%, and a balance of Fe and unavoidable impurities, the ferritic stainless steel sheet characterized by having an γp(L), which is defined by (formula 3-2), satisfying following (formula 3-1).

$$10 \leq \gamma p(\mathrm{L}) \leq 65 \quad \text{(formula 3-1)}$$

$$\gamma p(L) = 420\mathrm{C} + 470\mathrm{N} + 23\mathrm{Ni} + 7\mathrm{Mn} + 9\mathrm{Cu} - 11.5\mathrm{Cr} - 11.5\mathrm{Si} - 52\mathrm{Al} - 69\mathrm{Sn} + 189 \quad \text{(formula 3-2)}$$

wherein, each of C, N, Ni, Mn, Cu, Cr, Si, Al, and Sn denotes the content of the element.

(2-3) Ferritic stainless steel sheet which has excellent hot workability and rust resistance according to (2-1) or (2-2) characterized in that the ferritic stainless steel sheet further contains, by mass %, one or more elements of Mg: 0.005% or less, B: 0.005% or less, Ca: 0.005% or less, La: 0.1% or less, Y: 0.1% or less, Hf: 0.1% or less, and a REM: 0.1% or less.

(2-4) Ferritic stainless steel sheet which has excellent hot workability and rust resistance according to any one of (2-1) to (2-3) characterized in that the ferritic stainless steel sheet further contains, by mass %, one or more elements of Nb: 0.3% or less, Ti: 0.3% or less, Ni: 1.0% or less, Cu: 1.0% or less, Mo: 1.0% or less, V: 1.0% or less, Zr: 0.5% or less, and Co: 0.5% or less.

(2-5) A method of production of ferritic stainless steel sheet which has excellent hot workability and rust resistance characterized by heating a stainless steel slab having a composition of ingredients according to any one of the above to 1100 to 1300° C. and hot rolling the stainless steel slab to obtain a stainless steel sheet, and coiling the steel sheet at 700 to 1000° C. after finishing hot rolling.

The method of production of ferritic stainless steel sheet which has excellent hot workability and rust resistance according to (2-5) characterized by, after finishing hot rolling, not annealing the steel sheet or annealing the steel sheet at 700 to 1000° C. by continuous annealing or box annealing.

According to the steel sheet of the present invention providing the rust resistance, it is possible to provide a low Cr based or medium Cr based ferritic stainless steel and an alloy saving type of ferritic stainless steel sheet which improves the corrosion resistance over SUS430 and can be applied to general durable consumer goods, without relying on rare metals by effectively utilizing the Sn in recycled sources of iron.

[Embodiment for Working Invention Providing Improvement of Rust Resistance]

Regarding the ingredients in the second embodiment, the reasons for limitation of the composition of ingredients are the same as in the above-mentioned first embodiment.

Next, (formulas 2-2) and (3-2) which limit the range of γp(L) and γp(H) for securing the hot workability of Sn steel will be explained. γp(L) and γp(H) are indicators which show the maximum values of the amount of austenite which is formed when heating to 1100° C. The inventors found the effects of addition of Sn by experiments and added to the empirical formula for estimating the maximum phase percentage of the γ-phase the term of Sn of "−57.5Sn" at the time of medium Cr addition of Cr: 13 to 22% so as to obtain the following formula of γp(H). Further, similarly, they newly added the term of Sn of "−69Sn" at the time of low Cr addition of Cr: 11 to 13% so as to obtain the following formula:

$$\gamma p\ (\mathrm{H}) = 420\mathrm{C} + 470\mathrm{N} + 23\mathrm{Ni} + 7\mathrm{Mn} + 9\mathrm{Cu} - 11.5\mathrm{Cr} - 11.5\mathrm{Si} - 52\mathrm{Al} - 57.5\mathrm{Sn} + 189 \quad \text{(formula 2-2)}$$

$$\gamma p(L) = 420\mathrm{C} + 470\mathrm{N} + 23\mathrm{Ni} + 7\mathrm{Mn} + 9\mathrm{Cu} - 11.5\mathrm{Cr} - 11.5\mathrm{Si} - 52\mathrm{Al} - 69\mathrm{Sn} + 189 \quad \text{(formula 3-2)}$$

wherein, each of C, N, Ni, Mn, Cu, Cr, Si, Al, and Sn denotes the content of the element.

Note, in the Present Description, γp(L) and γp(H) will sometimes be referred to all together as "γp".

The experiments which the inventors ran and their results and the believed mechanism of action will be explained next. 50 kg amounts of 11 to 13% Cr steel and 13 to 16% Cr steel which contain 0.2% of Sn were melted in a vacuum and cast into steel ingots. From these, 42 mm thick block test pieces were prepared. These were allowed to stand for one month, then subjected to a hot rolling experiment.

In the hot rolling experiment, the block test pieces were heated to 1120° C. and rolled by a total rolling reduction rate of 88% (8 passes) and a final temperature of 700 to 900° C. to produce 5 mm thick hot rolled sheets. The hot rolled sheets were inspected at the two sides for any occurrence of edge cracking and were judged for quality of hot workability.

Edge cracking occurred along with the rise of the γp. At the boundary of 13% Cr, with 13% or less, the upper limit value rose. Hot working cracks occur with a high frequency at the phase boundary between the ferrite phase and the austenite phase which is formed at a high temperature. This is believed to be a result of the fact that due to the formation of the austenite phase with its small solubility of Sn, the Sn is spewed out to the ferrite phase side and, in the process, segregates at the crystal grain boundaries of austenite/ferrite resulting in a drop in the intergranular strength.

When the amount of Cr is 13% or less, the deformation resistance at a high temperature is small, so, it is believed, the upper limit value of the γp rises. On the other hand, if γp becomes smaller, season cracking of the steel ingot is aggravated. Sn is a ferrite forming element and is an element which refines the solidified structure due to the inoculation effect. For this reason, season cracking of the steel ingot, which occurred in the past when the γp was small, can be alleviated by refining the solidified structure through the addition of Sn.

Further, the contribution of Sn as a ferrite forming element is larger in comparison with Cr regardless of the fine amount of addition. The inventors ran experiments and observed the resultant structures. From this, they determined that the ferrite forming ability at 1100° C. was five times that of Cr at the time of medium Cr where Cr: over 13% and determined that it was six times that of Cr at the time of low Cr where Cr: 13% or less. As a result, they determined the coefficient for medium Cr based steel to be "−57.5(=−11.5×5)" and the coefficient for low Cr based steel to be "−69(=−11.5×6)".

Furthermore, the inventors prepared cold rolled, annealed sheets from 0.2% Sn steel, used SUS410L (12% Cr) and SUS430 (17% Cr) as comparative materials, and ran salt spray tests based on JIS Z 2371 using a 35° C., 5% NaCl aqueous solution to evaluate the rust resistance. The evaluated surfaces were polished by wet sandpaper #600. The solution was sprayed for 48 hours.

SUS410L rusted at the evaluation surface. Sn-containing 11 to 13% Cr steel and Sn-added 13 to 22% Cr steel did not rust in the same way as SUS430. As a result, the effect of improvement of the rust resistance due to the addition of Sn could be confirmed.

In the steel sheet of the present invention providing the rust resistance, to secure the required hot workability, the γp(H) which is defined by the above (formula 2-2) and the γp(L) which is defined by the above (formula 3-2) are limited as follows:

$$5 \leq \gamma p(\mathrm{H}) \leq 55 \quad \text{(formula 2-1)}$$

$$10 \leq \gamma p(\mathrm{L}) \leq 65 \quad \text{(formula 3-1)}$$

As shown in the above (formula 2-1) and (formula 3-1), the targeted hot workability can be secured by a γp(H) of 55 or less when Cr is over 13.0% and by a γp(L) of 65 or less when Cr is 13.0% or less. Note, "the targeted hot workability" means no edge cracking occurs in the above-mentioned hot rolling experiment.

The hot workability improves along with the drop in the γp. However, if the γp becomes excessively small, the season cracking susceptibility becomes higher and hot working cracks due to season cracking are induced. For this reason, the lower limit of γp(H) is made 5 with Cr: over 13.0%. If considering the effect and manufacturability, the preferable range is 10≤γp(H)≤40 with Cr: over 13.0%. On the other hand, the lower limit of γp(L) is made 10 with Cr: 13.0% or less. If considering the manufacturability, the preferable range, in the case of Cr: 13.0% or less, is 15≤γp(L)≤55.

Next, the reasons for limiting the conditions in the method of production of the steel sheet of the present invention providing the rust resistance will be explained. The heating temperature of the stainless steel slab which is used for hot rolling is made 1100° C. or more so as to suppress the formation of the austenite phase which leads to hot working cracks and reduces the deformation resistance at the time of hot rolling. If making the heating temperature excessively high, coarsening of the crystal grains causes the surface properties to deteriorate and, further, the shape of the slab is liable to worsen at the time of heating, so the upper limit is made 1300° C. From the viewpoints of the hot workability and the manufacturability, it is preferably 1150 to 1250° C.

From the viewpoint of hot workability, the temperature of coiling the steel sheet after hot rolling is made 700° C. or more so as to raise the heating temperature. If less than 700° C., surface cracks at the time of coiling or poor coil shapes are liable to be induced. If excessively raising the coiling temperature, formation of internal oxides and grain boundary oxidation is aggravated and the surface properties deteriorate, so the upper limit is made 1000° C. From the viewpoints of the hot workability and the manufacturability, it is preferably 700 to 900° C.

After hot rolling, the hot rolled sheet is annealed or is not annealed, but is cold rolled once or cold rolled twice or more with process annealing in between. The hot rolled steel sheet is annealed by continuous annealing or batch type box annealing at 700° C. or more where recrystallization is promoted. If excessively raising the annealing temperature, a drop in the surface properties and the pickling descaling ability is invited, so the upper limit is made 1000° C. From the viewpoint of the surface properties, it is preferably 700 to 900° C.

The final annealing after the cold rolling is performed in an oxidizing atmosphere or in a reducing atmosphere. The annealing temperature, if considering recrystallization, the surface properties, and descaling, is preferably 700 to 900° C. The pickling method is not particularly limited. A method which is commonly used industrially may be used. For example, dipping in an alkali salt bath+electrolytic pickling+dipping in nitrofluoric acid may be used. The electrolytic pickling is performed by electrolysis of neutral salts, electrolysis of nitric acid, etc.

EXAMPLES

Next, examples of the present invention will be explained, but the conditions of the examples are just illustrations which are employed for confirming the workability and advantageous effects of the present invention. The present invention is not limited to these illustrations of conditions. The present invention may employ various conditions so far as not departing from the gist of the present invention and achieving the object of the present invention.

Example 1

Ferritic stainless steels which have the compositions of ingredients which are shown in Table 3-1 and Table 3-2 (the two together sometimes being referred to as the "Tables 3") were melted in amounts of 150 kg in a vacuum and cast. The ingots were heated to 1000 to 1300° C. and hot rolled. The sheets were coiled at 500 to 700° C. to produce thickness 3.0 to 6.0 mm hot rolled steel sheets. In Tables 3, the asterisks indicate outside the provisions of the present invention, while "0" indicates no addition.

The hot rolled steel sheets were annealed simulating box annealing or continuous annealing or were not annealed, but cold rolled once or twice with process annealing in between to produce thickness 0.4 to 0.8 mm cold rolled steel sheets. The cold rolled steel sheets were final annealed at a temperature of 780 to 900° C. where recrystallization is completed. The final annealing was performed by oxidizing atmosphere annealing or bright annealing. For the comparative steels, SUS430(17Cr) and SUS430LX(17Cr) were used.

The hot workability was evaluated by inspecting for the presence of occurrence of edge cracking of the hot rolled sheets. Examples where no edge cracking at all occurred were evaluated as "G (good)", examples where edge cracking occurred from the end faces and reached the steel sheet surfaces were evaluated as "P (poor)", and examples where edge cracking did not reach the steel sheet surfaces were evaluated as "F (fair)". Examples where the edge cracking was evaluated as "G (good)" and "F (fair)" were deemed invention examples.

The rust resistance was evaluated by running a salt spray test based on JIS Z 2371 and further a dipping test of dipping in an 80° C., 0.5% Nacl aqueous solution for 168 hours. The degrees of rusting of the comparative steels due to the dipping test were "rusting at entire surface" for SUS430 and "no rusting" for SUS430LX. Therefore, for the evaluation indicators, rusting equivalent to SUS430 was deemed "G (good)", while "no rusting" equivalent to SUS430LX was deemed "VG (very good)". Note, exhibition of rusting and pinholes corresponding to SUS410L was deemed "P (poor)".

Table 4-1 and Table 4-2 (the two together sometimes referred to as the "Tables 4") show the manufacturing conditions and the test results together. In Table 4, an asterisk mark indicates deviation from provisions of the present invention, a P mark indicates deviation from the target of the present invention, and the – mark indicates nothing is performed. In Table 4, Test Nos. 2-1 to 2-3 and 2-7 to 2-26 and Test Nos. 3-1 to 3-3 and 3-7 to 3-26 are test examples relating to ferritic stainless steels which satisfy the composition of ingredients and γp which were prescribed in the second embodiment and which satisfy the manufacturing conditions. In these steel sheets, the hot workability which was targeted in the second embodiment and a rust resistance equal to SUS430 or no different from SUS430LX are obtained. Note, steel sheets which display a rust resistance no different from SUS430LX contain Cr in 14.5% or more.

Test Nos. 2-4 to 2-6 and Test Nos. 3-4 to 3-6 are test examples relating to ferritic stainless steels which have the composition of ingredients and γp which are prescribed by the second embodiment, but have manufacturing conditions which deviate from the manufacturing conditions which are prescribed by the second embodiment. In these steel sheets, edge cracking cannot be suppressed, but the targeted hot workability is obtained.

Test Nos. 2-27 to 2-31 and Test Nos. 3-27 to 3-32 are test examples relating to ferritic stainless steel where the compositions of ingredients and γp are outside the composition of ingredients and γp which are prescribed by the second embodiment. In these steel sheets, one or both of the targeted hot workability and rust resistance are not obtained.

Test Nos. 2-32 to 2-34 and Test Nos. 3-33 to 3-35 are test examples relating to ferritic stainless steels which have the compositions of ingredients which are prescribed by the second embodiment, but where the γp's are outside the γp which is prescribed by the second embodiment. In these steel sheets, the targeted rust resistance is obtained, but the targeted hot workability is not obtained. In the ferritic stainless steels of Test Nos. 2-32 and Test Nos. 3-33, the γp is small, so cracks due to season cracking are manifested due to hot working. Test Nos. 2-35 and 2-36 and 3-36 and 3-37 are respectively reference examples relating to SUS410L and SUS430.

INDUSTRIAL APPLICABILITY

As explained above, according to the present invention, it is possible to provide ferritic stainless steel sheet which has excellent ridging resistance, rust resistance, and workability without relying on use of rare metals by effectively utilizing the Sn in recycled sources of iron. Further, it is possible to provide ferritic stainless steel which has excellent rust resistance and workability. As a result, the present invention can simplify the conventionally required polishing step and can contribute to global environment protection, so the industrial applicability is high.

TABLE 1

Chemical Composition of Tested Steel (mass %)

| Steel | C | Si | Mn | P | S | Cr | N | Al | Nb | Ti |
|---|---|---|---|---|---|---|---|---|---|---|
| A | 0.070 | 0.26 | 0.42 | 0.028 | 0.001 | 16.1 | 0.017 | | | |
| B | 0.045 | 0.61 | 0.08 | 0.035 | 0.004 | 17.2 | 0.022 | 0.12 | | |
| C | 0.013 | 0.24 | 0.78 | 0.014 | 0.005 | 12.5 | 0.011 | | 0.09 | |
| D | 0.120 | 0.84 | 0.23 | 0.035 | 0.001 | 14.2 | 0.011 | 0.19 | 0.05 | 0.06 |
| E | 0.055 | 0.25 | 0.36 | 0.044 | 0.001 | 14.6 | 0.035 | | | |
| E | 0.035 | 0.33 | 1.79 | 0.023 | 0.007 | 15.5 | 0.025 | 0.03 | | |
| G | 0.087 | 0.15 | 0.64 | 0.034 | 0.002 | 16.2 | 0.034 | | | |
| H | 0.048 | 0.30 | 0.19 | 0.031 | 0.003 | 16.1 | 0.010 | 0.02 | | |
| I | 0.003 | 0.03 | 0.35 | 0.039 | 0.002 | 11.6 | 0.045 | 0.18 | 0.09 | |
| J | 0.064 | 0.43 | 0.11 | 0.022 | 0.003 | 17.9 | 0.026 | 0.01 | | 0.06 |
| K | 0.049 | 0.65 | 0.89 | 0.019 | 0.002 | 16.5 | 0.013 | 0.04 | | |
| L | 0.019 | 0.45 | 1.22 | 0.026 | 0.001 | 16.2 | 0.036 | | | |
| M | 0.067 | 0.30 | 0.70 | 0.031 | 0.003 | 16.2 | 0.038 | | | |
| N | 0.009 | 0.11 | 0.90 | 0.031 | 0.003 | 13.2 | 0.033 | 0.00 | | |
| O | 0.049 | 0.30 | 0.20 | 0.029 | 0.003 | 15.9 | 0.013 | 0.12 | | |
| P | 0.025 | 0.18 | 0.98 | 0.022 | 0.001 | 14.8 | 0.024 | 0.00 | | |
| Q | 0.080 | 0.87 | 0.23 | 0.042 | 0.005 | 16.2 | 0.031 | | | |
| R | 0.065 | 0.28 | 0.68 | 0.033 | 0.002 | 16.0 | 0.027 | 0.01 | | |
| S | 0.084 | 0.11 | 1.15 | 0.041 | 0.002 | 14.2 | 0.027 | 0.09 | | 0.04 |
| T | 0.045 | 0.72 | 0.55 | 0.022 | 0.001 | 18.0 | 0.016 | 0.02 | | |
| U | 0.220 | 0.45 | 0.21 | 0.009 | 0.003 | 20.5 | 0.035 | 0.05 | | |
| V | 0.089 | 0.86 | 0.78 | 0.035 | 0.012 | 21.3 | 0.077 | 0.35 | | |
| W | 0.035 | 0.42 | 0.81 | 0.010 | 0.002 | 14.5 | 0.033 | 0.00 | | 0.25 |
| X | 0.092 | 0.05 | 0.63 | 0.016 | 0.008 | 15.5 | 0.045 | 0.75 | | |
| Y | 0.087 | 0.85 | 0.15 | 0.025 | 0.006 | 18.3 | 0.066 | | 0.28 | |
| Z | 0.062 | 0.28 | 0.66 | 0.025 | 0.001 | 16.0 | 0.035 | | | |

| Steel | Ni | Cu | Mo | B | Mg | Ca | Sn | Ap | 0.634-0.0082Ap | Others |
|---|---|---|---|---|---|---|---|---|---|---|
| A | | | | | | | 0.09 | 41.2 | 0.296 | |
| B | 0.12 | | | | | | 0.52 | 10.5 | 0.548 | |

TABLE 1-continued

| Chemical Composition of Tested Steel (mass %) | | | | | | | | | | |
|---|---|---|---|---|---|---|---|---|---|---|
| C | | | | 0.0004 | | | 0.15 | 54.4 | 0.188 | |
| D | | | 0.20 | | 0.0024 | | 0.12 | 55.7 | 0.178 | |
| E | | 0.21 | | | | | 0.08 | 62.2 | 0.124 | |
| E | | | | | | 0.0005 | 0.21 | 44.4 | 0.270 | |
| G | | | | | | | 0.11 | 58.0 | 0.159 | |
| H | | | | | | | 0.20 | 25.6 | 0.424 | |
| I | | | | 0.0003 | 0.0018 | | 0.07 | 66.5 | 0.088 | |
| J | 0.15 | 0.09 | 0.04 | 0.0024 | | | 0.44 | 18.6 | 0.481 | |
| K | | | | | | | 0.23 | 22.6 | 0.449 | |
| L | | 0.04 | | | 0.0002 | 0.0028 | 0.28 | 31.2 | 0.378 | |
| M | 0.10 | | | | | | 0.22 | 52.5 | 0.204 | |
| N | | | | | | | 0.10 | 61.3 | 0.132 | |
| O | 0.10 | | | | | | 0.30 | 26.9 | 0.414 | |
| P | | | | | | | 0.35 | 45.2 | 0.264 | |
| Q | | 0.08 | 0.12 | | | | 0.04 | 41.8 | 0.292 | |
| R | | | | | | | 0.00 | 46.0 | 0.257 | |
| S | | | 0.18 | | | | 0.24 | 71.7 | 0.046 | |
| T | 0.10 | | | 0.0060 | | | 0.18 | 5.3 | 0.591 | |
| U | | | | | | | 0.12 | 55.6 | 0.178 | 0.03Co, 0.44Zr |
| V | 0.98 | | | | | | 0.26 | 17.5 | 0.490 | 0.92V, 0.025Zr, 0.0035REM, 0.0012Y, 0.33Hf |
| W | | | 0.87 | | | | 0.22 | 30.6 | 0.383 | 0.03V, 0.23Y |
| X | 0.72 | 0.44 | 0.84 | 0.0042 | 0.0045 | | 0.08 | 45.8 | 0.258 | 0.012REM, 0.035Y |
| Y | | 0.68 | | | | 0.0048 | 0.19 | 30.3 | 0.385 | 0.44Co, 0.025Hf, 0.33V |
| Z | 0.10 | | | | | | 0.20 | 51.2 | 0.214 | |

TABLE 2-1

| Ex. | Steel | Heating temp. (° C.) | Total rolling reduction rate at 1100° C. or more at hot rolling (%) | Presence of edge cracking of hot rolled sheet | Surface defects of hot rolled sheet | Coiling temp. (° C.) | Hot rolled sheet annealing conditions | Ridging judgment | |
|---|---|---|---|---|---|---|---|---|---|
| 1 | A | 1160 | 0 | No | No | 650 | 820° C. × 6 h | C | Comp. ex. |
| 2 | A | 1250 | 25 | No | No | 550 | 870° C. × 2 min | A | Inv. ex. |
| 3 | A | 1290 | 15 | No | Yes | 800 | Omitted | B | Comp. ex. |
| 4 | B | 1200 | 10 | No | No | 400 | 820° C. × 6 h | C | Comp. ex. |
| 5 | B | 1200 | 20 | No | No | 450 | 870° C. × 2 min | AA | Inv. ex. |
| 6 | B | 1160 | 15 | No | No | 660 | Omitted | AA | Inv. ex. |
| 7 | C | 1100 | 8 | No | No | 550 | Omitted | C | Comp. ex. |
| 8 | C | 1180 | 8 | No | No | 600 | 820° C. × 6 h | C | Comp. ex. |
| 9 | C | 1230 | 18 | No | No | 650 | 870° C. × 2 min | AA | Inv. ex. |
| 10 | D | 1220 | 15 | No | No | 800 | 870° C. × 2 min | A | Inv. ex. |
| 11 | D | 1200 | 10 | No | No | 780 | Omitted | C | Comp. ex. |
| 12 | D | 1180 | 15 | No | No | 350 | 820° C. × 6 h | A | Inv. ex. |
| 13 | E | 1260 | 25 | No | No | 600 | Omitted | A | Inv. ex. |
| 14 | E | 1240 | 12 | No | No | 450 | 870° C. × 2 min | C | Comp. ex. |
| 15 | E | 1140 | 5 | No | No | 600 | Omitted | B | Comp. ex. |
| 16 | F | 1180 | 5 | No | No | 550 | 820° C. × 6 h | C | Comp. ex. |
| 17 | F | 1220 | 30 | No | No | 750 | 870° C. × 2 min | AA | Inv. ex. |
| 18 | F | 1220 | 4 | No | No | 700 | Omitted | C | Comp. ex. |
| 19 | G | 1200 | 15 | No | No | 450 | 820° C. × 6 h | A | Inv. ex. |
| 20 | G | 1250 | 0 | No | No | 650 | Omitted | C | Comp. ex. |
| 21 | G | 1050 | 0 | No | No | 530 | 870° C. × 2 min | C | Comp. ex. |
| 22 | H | 1200 | 20 | No | No | 390 | 820° C. × 6 h | AA | Inv. ex. |
| 23 | H | 1250 | 12 | No | No | 560 | 870° C. × 2 min | C | Comp. ex. |
| 24 | H | 1180 | 4 | No | No | 660 | Omitted | C | Comp. ex. |
| 25 | I | 1200 | 18 | No | No | 550 | 870° C. × 2 min | A | Inv. ex. |
| 26 | I | 1250 | 18 | No | No | 710 | 820° C. × 6 h | A | Inv. ex. |
| 27 | I | 1240 | 8 | No | No | 800 | Omitted | C | Comp. ex. |
| 28 | J | 1200 | 20 | No | No | 340 | Omitted | AA | Inv. ex. |
| 29 | J | 1300 | 20 | No | Yes | 500 | 820° C. × 6 h | B | Comp. ex. |

-continued

| | | | | | | | | | |
|---|---|---|---|---|---|---|---|---|---|
| 30 | J | 1200 | 15 | No | No | 460 | 870° C. × 2 min | AA | Inv. ex. |
| 31 | K | 1200 | 11 | No | No | 720 | Omitted | C | Comp. ex. |
| 32 | K | 1200 | 19 | No | No | 660 | 820° C. × 6 h | AA | Inv. ex. |
| 33 | K | 1250 | 25 | No | No | 610 | Omitted | AA | Inv. ex. |
| 34 | L | 1080 | 0 | No | No | 480 | 820° C. × 6 h | C | Comp. ex. |
| 35 | L | 1240 | 15 | No | No | 570 | 870 ° C. × 2 min | AA | Inv. ex. |
| 36 | L | 1240 | 25 | No | No | 390 | Omitted | AA | Comp. ex. |
| 37 | M | 1200 | 2 | No | No | 450 | Omitted | C | Comp. ex. |
| 38 | M | 1300 | 20 | No | Yes | 600 | 870° C. × 2 min | B | Comp. ex. |
| 39 | M | 1240 | 20 | No | No | 500 | 820° C. × 6 h | B | Comp. ex. |

Table 2-2

| Ex. | Steel | Heating temp. (° C.) | Total rolling reduction rate at 1100° C. or more at hot rolling (%) | Presence of edge cracking of hot rolled sheet | Surface defects of hot rolled sheet | Coiling temp. (° C.) | Hot rolled sheet annealing conditions | Ridging judgment | |
|---|---|---|---|---|---|---|---|---|---|
| 40 | N | 1230 | 15 | No | No | 720 | 820° C. × 6 h | A | Inv. ex. |
| 41 | N | 1170 | 8 | No | No | 460 | 870° C. × 2 min | C | Comp. ex. |
| 42 | N | 1160 | 15 | No | No | 650 | Omitted | A | Inv. ex. |
| 43 | O | 1250 | 20 | No | No | 550 | 820° C. × 6 h | A | Comp. ex. |
| 44 | O | 1130 | 10 | No | No | 580 | Omitted | C | Comp. ex. |
| 45 | O | 1180 | 15 | No | No | 600 | 870° C. × 2 min | A | Inv. ex. |
| 46 | P | 1250 | 0 | Yes | No | 470 | 870° C. × 2 min | C | Comp. ex. |
| 47 | P | 1240 | 20 | Yes | No | 380 | 820° C. × 6 h | B | Comp. ex. |
| 48 | P | 1200 | 15 | Yes | No | 620 | Omitted | B | Comp. ex. |
| 49 | Q | 1200 | 15 | No | No | 800 | Omitted | C | Comp. ex. |
| 50 | Q | 1150 | 15 | No | No | 750 | 870° C. × 2 min | C | Comp. ex. |
| 51 | Q | 1260 | 25 | No | No | 600 | 820° C. × 6 h | C | Comp. ex. |
| 52 | R | 1230 | 25 | No | No | 550 | Omitted | C | Comp. ex. |
| 53 | R | 1180 | 15 | No | No | 650 | 870° C. × 2 min | C | Comp. ex. |
| 54 | R | 1180 | 3 | No | No | 700 | 820° C. × 6 h | C | Comp. ex. |
| 55 | S | 1200 | 3 | Yes | No | 620 | Omitted | B | Comp. ex. |
| 56 | S | 1150 | 15 | Yes | No | 750 | 870° C. × 2 min | B | Comp. ex. |
| 57 | S | 1260 | 25 | Yes | No | 700 | 820° C. × 6 h | B | Comp. ex. |
| 58 | T | 1230 | 25 | No | No | 550 | Omitted | C | Comp. ex. |
| 59 | T | 1180 | 15 | No | No | 650 | 870° C. × 2 min | C | Comp. ex. |
| 60 | T | 1180 | 3 | No | No | 750 | 820° C. × 6 h | C | Comp. ex. |
| 61 | U | 1235 | 18 | No | No | 550 | 820° C. × 6 h | A | Inv. ex. |
| 62 | U | 1140 | 7 | No | No | 580 | Omitted | C | Comp. ex. |
| 63 | U | 1200 | 5 | No | No | 600 | 870° C. × 2 min | C | Inv. ex. |
| 64 | V | 1250 | 15 | No | No | 600 | 820° C. × 6 h | A | Inv. ex. |
| 65 | V | 1080 | 0 | No | No | 550 | Omitted | C | Comp. ex. |
| 66 | V | 1170 | 20 | No | No | 600 | 870° C. × 2 min | A | Inv. ex. |
| 67 | W | 1230 | 5 | No | No | 625 | 820° C. × 6 h | C | Inv. ex. |
| 68 | W | 1120 | 3 | No | No | 550 | Omitted | C | Comp. ex. |
| 69 | W | 1200 | 18 | No | No | 500 | 870° C. × 2 min | A | Inv. ex. |
| 70 | X | 1200 | 18 | No | No | 480 | 820° C. × 6 h | A | Inv. ex. |
| 71 | X | 1125 | 5 | No | No | 550 | Omitted | C | Comp. ex. |
| 72 | X | 1200 | 17 | No | No | 560 | 870° C. × 2 min | A | Inv. ex. |
| 73 | Y | 1240 | 18 | No | No | 600 | 820° C. × 6 h | A | Inv. ex. |
| 74 | Y | 1130 | 12 | No | No | 580 | Omitted | C | Comp. ex. |
| 75 | Y | 1200 | 18 | No | No | 575 | 870° C. × 2 min | A | Inv. ex. |
| 76 | Z | 1180 | 18 | No | No | 575 | 870° C. × 2 min | A | Inv. ex. |
| 77 | Z | 1180 | 3 | No | No | 550 | 870° C. × 2 min | B | Comp. ex. |
| 78 | Z | 1120 | 3 | No | No | 575 | 870° C. × 2 min | 3 | Comp. ex. |

Table 3-1 Medium Cr Ferritic Stainless Steel

| | C | Si | Mn | P | S | Cr | N | Al | Sn | Ni | Cu | γp | Others |
|---|---|---|---|---|---|---|---|---|---|---|---|---|---|
| 2A | 0.022 | 0.35 | 0.25 | 0.021 | 0.0021 | 14.3 | 0.033 | 0.03 | 0.17 | 0 | 0 | 35.7 | |
| 2B | 0.075 | 0.45 | 0.31 | 0.025 | 0.0025 | 14.2 | 0.012 | 0.04 | 0.11 | 0 | 0 | 51.4 | |
| 2C | 0.011 | 0.11 | 0.45 | 0.022 | 0.0007 | 14.8 | 0.025 | 0.05 | 0.25 | 0 | 0 | 20.1 | |
| 2D | 0.035 | 0.72 | 0.42 | 0.021 | 0.0021 | 13.8 | 0.021 | 0.05 | 0.31 | 0 | 0 | 29.1 | |
| 2E | 0.032 | 0.08 | 0.11 | 0.035 | 0.0018 | 14.4 | 0.022 | 0.04 | 0.17 | 0 | 0 | 35.2 | |
| 2F | 0.038 | 0.25 | 1.25 | 0.028 | 0.0021 | 15.2 | 0.008 | 0.02 | 0.21 | 0 | 0 | 26.7 | |
| 2G | 0.022 | 0.55 | 0.02 | 0.021 | 0.0021 | 14.1 | 0.033 | 0.01 | 0.15 | 0 | 0 | 36.3 | |
| 2H | 0.025 | 0.28 | 0.32 | 0.024 | 0.0055 | 15.8 | 0.038 | 0.03 | 0.2 | 0 | 0 | 21.6 | |
| 2I | 0.022 | 0.35 | 0.15 | 0.021 | 0.0003 | 13.2 | 0.015 | 0.02 | 0.33 | 0 | 0 | 30.5 | |

-continued

| | | | | | | | | | | | | | |
|---|---|---|---|---|---|---|---|---|---|---|---|---|---|
| 2J | 0.035 | 0.25 | 0.35 | 0.023 | 0.0005 | 16.2 | 0.058 | 0.03 | 0.22 | 0 | 0 | 30 | |
| 2K | 0.015 | 0.15 | 0.08 | 0.021 | 0.0005 | 14.6 | 0.022 | 0.002 | 0.21 | 0.15 | 0 | 27.8 | Ni: 0.15 |
| 2L | 0.033 | 0.09 | 0.55 | 0.022 | 0.0006 | 13.4 | 0.035 | 0.68 | 0.33 | 0 | 0 | 13.7 | |
| 2M | 0.018 | 0.12 | 0.11 | 0.023 | 0.0008 | 14.9 | 0.033 | 0.04 | 0.56 | 0 | 0 | 6.1 | |
| 2N | 0.055 | 0.31 | 0.45 | 0.031 | 0.0015 | 17.2 | 0.038 | 0.01 | 0.09 | 0 | 0 | 26.1 | |
| 2O | 0.025 | 0.3 | 0.35 | 0.023 | 0.0021 | 14.7 | 0.028 | 0.02 | 0.15 | 0 | 0 | 32.9 | B: 0.0006 |
| 2P | 0.018 | 0.25 | 0.45 | 0.023 | 0.0021 | 14.8 | 0.028 | 0.02 | 0.31 | 0 | 0 | 20.9 | Ca: 0.0006, La: 0.02 |
| 2Q | 0.025 | 0.33 | 0.55 | 0.023 | 0.0021 | 14.5 | 0.028 | 0.02 | 0.15 | 0 | 0 | 36.3 | Y + Hf + RFM: 0.09 |
| 2R | 0.022 | 0.45 | 0.21 | 0.023 | 0.0021 | 14.4 | 0.018 | 0.02 | 0.15 | 0.25 | 0 | 33.5 | Nb: 0.07, Ni: 0.25 |
| 2S | 0.026 | 0.32 | 0.35 | 0.023 | 0.0021 | 14.1 | 0.022 | 0.02 | 0.21 | 0 | 0.2 | 35.6 | Cu: 0.2, Mo: 0.1, V: 0.3 |
| 2T | 0.022 | 0.38 | 0.12 | 0.023 | 0.0021 | 14.3 | 0.021 | 0.02 | 0.15 | 0.15 | 0 | 33.9 | Mg: 0.0004, Ti: 0.06, Ni: 0.15 |
| 2U | 0.022 | 0.38 | 0.12 | 0.023 | 0.0021 | 14.3 | 0.021 | 0.02 | 0.15 | 0 | 0 | 30.5 | Zr: 0.03, Co: 0.02 |
| 2V* | 0.31 | 0.5 | 0.15 | 0.023 | 0.0021 | 14.2 | 0.015 | 0.05 | 0.21 | 0 | 0 | 143.6 | |
| 2W* | 0.025 | 0.3 | 2.2 | 0.025 | 0.0025 | 14.6 | 0.012 | 0.05 | 0.15 | 0 | 0 | 38 | |
| 2X* | 0.023 | 0.3 | 0.35 | 0.023 | 0.0021 | 14.3 | 0.028 | 0.02 | 0.21 | 0 | 0 | 33.3 | |
| 2Y* | 0.011 | 0.5 | 0.25 | 0.025 | 0.0025 | 14.3 | 0.11 | 0.03 | 0.12 | 0 | 0 | 68.4 | |
| 2Z* | 0.024 | 0.3 | 0.35 | 0.023 | 0.0021 | 14.4 | 0.021 | 0.02 | 0.04 | 0 | 0 | 39 | |
| ZZA* | 0.031 | 0.45 | 0.33 | 0.023 | 0.0021 | 14.6 | 0.035 | 1.05 | 0.15 | 0 | 0 | −15.5 | |
| 2ZB* | 0.004 | 0.55 | 0.08 | 0.025 | 0.0018 | 14.6 | 0.006 | 0.08 | 0.19 | 0 | 0 | 4.8 | |
| 2ZC* | 0.055 | 0.35 | 0.55 | 0.023 | 0.0015 | 13.8 | 0.025 | 0.02 | 0.14 | 0 | 0 | 55.9 | |
| SUS430 | 0.07 | 0.3 | 0.65 | 0.035 | 0.003 | 16.6 | 0.035 | 0.005 | 0 | 0.1 | 0.1 | 48 | Ti: 0.25 |
| SUS430LX | 0.005 | 0.12 | 0.15 | 0.002 | 0.0011 | 16.5 | 0.011 | 0.045 | 0 | 0 | 0 | 3.8 | Ti: 0.27 |

Table 3-2 Low Cr Ferritic Stainless Steel Sheet

| | C | Si | Mn | P | S | Cr | N | Al | Sn | Ni | Cu | γP | Others |
|---|---|---|---|---|---|---|---|---|---|---|---|---|---|
| 3A | 0.025 | 0.41 | 0.32 | 0.021 | 0.0021 | 12.6 | 0.035 | 0.04 | 0.17 | 0 | 0 | 54.8 | |
| 3B | 0.08 | 0.47 | 0.25 | 0.025 | 0.0025 | 12.8 | 0.011 | 0.07 | 0.13 | 0 | 0 | 64.3 | |
| 3C | 0.011 | 0.11 | 0.12 | 0.022 | 0.0007 | 12.8 | 0.025 | 0.35 | 0.25 | 0 | 0 | 22.3 | |
| 3D | 0.035 | 0.72 | 0.42 | 0.021 | 0.0021 | 11.8 | 0.018 | 0.05 | 0.31 | 0 | 0 | 47.1 | |
| 3E | 0.032 | 0.08 | 0.11 | 0.035 | 0.0018 | 12.5 | 0.022 | 0.04 | 0.17 | 0 | 0 | 55.1 | |
| 3F | 0.038 | 0.25 | 1.25 | 0.028 | 0.0021 | 12.6 | 0.008 | 0.02 | 0.21 | 0 | 0 | 54.2 | |
| 3G | 0.022 | 0.55 | 0.02 | 0.021 | 0.0021 | 12.2 | 0.028 | 0.25 | 0.15 | 0 | 0 | 41.6 | |
| 3H | 0.011 | 0.12 | 0.11 | 0.024 | 0.0055 | 12.8 | 0.009 | 0.03 | 0.2 | 0 | 0 | 34.7 | |
| 3I | 0.022 | 0.35 | 0.15 | 0.021 | 0.0003 | 11.2 | 0.015 | 0.03 | 0.35 | 0 | 0 | 47.8 | |
| 3J | 0.022 | 0.25 | 0.22 | 0.023 | 0.0005 | 12.4 | 0.06 | 0.25 | 0.22 | 0 | 0 | 54.3 | |
| 3K | 0.005 | 0.15 | 0.08 | 0.021 | 0.0005 | 12.3 | 0.01 | 0.002 | 0.11 | 0 | 0 | 45.5 | |
| 3L | 0.022 | 0.09 | 0.08 | 0.022 | 0.0006 | 11.8 | 0.018 | 0.68 | 0.33 | 0 | 0 | 12.4 | |
| 3M | 0.012 | 0.12 | 0.11 | 0.023 | 0.0008 | 12.6 | 0.011 | 0.04 | 0.55 | 0 | 0 | 13.9 | |
| 3N | 0.031 | 0.25 | 0.25 | 0.031 | 0.0015 | 12.8 | 0.018 | 0.06 | 0.08 | 0.15 | 0 | 57 | Ni: 0.15 |
| 3O | 0.025 | 0.3 | 0.35 | 0.023 | 0.0021 | 12.2 | 0.028 | 0.02 | 0.15 | 0 | 0 | 60 | B: 0.0008 |
| 3P | 0.018 | 0.25 | 0.45 | 0.023 | 0.0021 | 11.9 | 0.028 | 0.02 | 0.31 | 0 | 0 | 50.7 | Ca: 0.0006, La: 0.03 |
| 3Q | 0.025 | 0.33 | 0.55 | 0.023 | 0.0021 | 12.5 | 0.028 | 0.02 | 0.15 | 0 | 0 | 57.6 | Y: 0.02, Hf: 0.03, REM: 0.03 |
| 3R | 0.022 | 0.45 | 0.21 | 0.023 | 0.0021 | 12.4 | 0.018 | 0.02 | 0.15 | 0.3 | 0 | 55.9 | Nb: 0.05, Ni: 0.3 |
| 3S | 0.026 | 0.32 | 0.35 | 0.023 | 0.0021 | 12.1 | 0.022 | 0.02 | 0.21 | 0 | 0.2 | 56.2 | Cu: 0.2, Mo: 0.1, V: 0.2 |
| 3T | 0.022 | 0.38 | 0.12 | 0.023 | 0.0021 | 12.3 | 0.021 | 0.02 | 0.15 | 0.2 | 0 | 56.3 | Mg: 0.0007, Ti: 0.05, Ni: 0.2 |
| 3U | 0.023 | 0.35 | 0.15 | 0.025 | 0.0018 | 12.5 | 0.028 | 0.03 | 0.18 | 0 | 0 | 51.1 | Zr: 0.03, Co: 0.02 |
| 3V* | 0.31 | 0.5 | 0.15 | 0.023 | 0.0021 | 12.2 | 0.015 | 0.05 | 0.21 | 0 | 0 | 164.2 | |
| 3W* | 0.025 | 0.3 | 2.2 | 0.025 | 0.0025 | 12.6 | 0.012 | 0.05 | 0.15 | 0 | 0 | 59.2 | |
| 3X* | 0.023 | 0.3 | 0.35 | 0.023 | 0.021 | 12.3 | 0.028 | 0.02 | 0.21 | 0 | 0 | 53.8 | |
| 3Y* | 0.022 | 0.5 | 0.45 | 0.023 | 0.0021 | 10.7 | 0.02 | 0.02 | 0.15 | 0 | 0 | 70.5 | |
| 3Z* | 0.011 | 0.5 | 0.25 | 0.025 | 0.0025 | 12.3 | 0.12 | 0.03 | 0.12 | 0 | 0 | 94.7 | |
| 3ZA* | 0.024 | 0.3 | 0.35 | 0.023 | 0.0021 | 12.4 | 0.021 | 0.02 | 0.04 | 0 | 0 | 61.6 | |
| 3ZB* | 0.031 | 0.45 | 0.33 | 0.023 | 0.0021 | 12.6 | 0.035 | 1.05 | 0.15 | 0 | 0 | 5.8 | |
| 3ZC* | 0.011 | 0.5 | 0.15 | 0.025 | 0.0018 | 12.8 | 0.015 | 0.58 | 0.13 | 0 | 0 | 9.6 | |
| 3ZD* | 0.055 | 0.35 | 0.55 | 0.023 | 0.0015 | 12.6 | 0.025 | 0.02 | 0.14 | 0 | 0 | 68.1 | |
| SUS410L | 0.02 | 0.45 | 0.55 | 0.03 | 0.002 | 12.2 | 0.015 | 0.03 | 0 | 0 | 0 | 61.3 | Ti: 0.25 |
| SUS430 | 0.07 | 0.3 | 0.65 | 0.035 | 0.003 | 16.6 | 0.035 | 0.005 | 0 | 0.1 | 0.1 | 48 | |

Table 4-1 Medium Cr Ferritic Stainless Steel Sheet

| | No. | Steel | Heating ° C. | Coiling ° C. | Hot rolled sheet annealing (° C.) Continuous annealing | Hot rolled sheet annealing (° C.) Box annealing | Hot workability (edge cracking) | Rust resistance Spray | Rust resistance Dipping | Remarks |
|---|---|---|---|---|---|---|---|---|---|---|
| Steel of ingredients of second aspect (medium Cr ferritic stainless steel sheet) | 2-1 | 2A | 1210 | 780 | — | 810 | G | G | G | |
| | 2-2 | | 1210 | 78D | 830 | — | G | G | G | |
| | 2-3 | | 1210 | 780 | — | — | G | G | G | |
| | 2-4 | | 1080* | 600* | 830 | — | F | G | G | |
| | 2-5 | | 1120 | 660* | 830 | — | F | G | G | |
| | 2-6 | | 1090* | 700 | 830 | — | F | G | G | |
| | 2-7 | 2B | 1220 | 750 | 820 | — | G | G | G | |
| | 2-8 | 2C | 1230 | 790 | — | 810 | G | G | G | |
| | 2-9 | 2D | 1180 | 740 | 800 | — | G | G | G | |
| | 2-10 | 2E | 1190 | 750 | — | 810 | G | G | G | |
| | 2-11 | 2F | 1220 | 760 | — | 820 | G | G | VG | |
| | 2-12 | 2G | 1180 | 740 | — | 820 | G | G | G | |
| | 2-13 | 2H | 1230 | 810 | 810 | — | G | G | VG | |
| | 2-14 | 2I | 1160 | 720 | 800 | — | G | G | G | |
| | 2-15 | 2J | 1190 | 740 | 800 | — | G | G | VG | |
| | 2-16 | 2K | 1180 | 760 | — | 810 | G | G | G | |
| | 2-17 | 2L | 1150 | 700 | — | 820 | G | G | G | |
| | 2-18 | 2M | 1210 | 780 | — | 810 | G | G | VG | |
| | 2-19 | 2N | 1190 | 730 | — | 850 | G | G | VG | |
| | 2-20 | 2O | 1180 | 720 | — | — | G | G | G | |
| | 2-21 | 2P | 1170 | 720 | 800 | — | G | G | VG | |
| | 2-22 | 2Q | 1190 | 730 | — | 820 | G | G | G | |
| | 2-23 | 2R | 1180 | 740 | — | 810 | G | G | G | |
| | 2-24 | 2S | 1170 | 710 | — | 810 | G | G | G | |
| | 2-25 | 2T | 1160 | 700 | — | 810 | G | G | G | |
| | 2-26 | 2U | 1160 | 700 | — | 810 | G | G | G | |
| Comparative ingredients | 2-27 | 2V* | 1180 | 730 | — | 800 | P | P | P | |
| | 2-28 | 2W* | 1190 | 760 | — | 800 | G | P | P | |
| | 2-29 | 2X* | 1170 | 720 | — | 810 | G | P | P | |
| | 2-30 | 2Y* | 1150 | 710 | 810 | — | P | P | P | |
| | 2-31 | 2Z* | 1210 | 780 | 820 | — | G | P | P | |
| | 2-32 | 2ZA* | 1180 | 760 | 830 | — | P | G | G | |
| | 2-33 | 2ZB* | 1180 | 760 | 820 | — | P | G | G | |
| | 2-34 | 2ZC* | 1180 | 760 | 830 | — | P | G | G | |
| | 2-35 | SUS430 | | | | | | G | G | |
| | 2-36 | S430LA | | | | | | G | VG | |

Table 4-2 Low Cr Ferritic Stainless Steel

| | No. | Steel | Heating ° C. | Coiling ° C. | Hot rolled sheet annealing (° C.) Continuous annealing | Hot rolled sheet annealing (° C.) Box annealing | Hot workability (edge cracking) | Rust resistance Spray | Rust resistance Dipping |
|---|---|---|---|---|---|---|---|---|---|
| Steel of ingredients of second aspect (low Cr ferritic stainless steel sheet) | 3-1 | 3A | 1210 | 780 | — | 780 | G | G | G |
| | 3-2 | | 1210 | 780 | 820 | — | G | G | G |
| | 3-3 | | 1210 | 780 | — | — | G | G | G |
| | 3-4 | | 1080* | 600* | 820 | — | F | G | P |
| | 3-5 | | 1120 | 660* | 820 | — | F | G | G |
| | 3-6 | | 1090* | 700 | 820 | — | F | G | G |
| | 3-7 | 3B | 1220 | 750 | 810 | — | G | G | G |
| | 3-8 | 3C | 1230 | 790 | — | 790 | G | G | G |
| | 3-9 | 3D | 1180 | 740 | 790 | — | G | G | G |
| | 3-10 | 3E | 1190 | 750 | — | 780 | G | G | G |
| | 3-11 | 3F | 1220 | 760 | — | 810 | G | G | G |
| | 3-12 | 3G | 1180 | 740 | — | 810 | G | G | G |
| | 3-13 | 3H | 1230 | 810 | 810 | — | G | G | G |
| | 3-14 | 3I | 1160 | 720 | 790 | — | G | G | G |
| | 3-15 | 3J | 1190 | 740 | 780 | — | G | G | G |
| | 3-16 | 3K | 1180 | 760 | — | 790 | G | G | G |
| | 3-17 | 3L | 1150 | 700 | — | 810 | G | G | G |
| | 3-18 | 3M | 1210 | 780 | — | 790 | G | G | G |
| | 3-19 | 3N | 1190 | 730 | — | — | G | G | G |
| | 3-20 | 3O | 1180 | 720 | 790 | — | G | G | G |
| | 3-21 | 3P | 1170 | 720 | 790 | — | G | G | G |
| | 3-22 | 3Q | 1190 | 730 | — | 810 | G | G | G |
| | 3-23 | 3R | 1180 | 740 | — | 780 | G | G | G |
| | 3-24 | 3S | 1170 | 710 | — | 790 | G | G | G |
| | 3-25 | 3T | 1180 | 700 | — | 790 | G | G | G |
| | 3-26 | 3U | 1160 | 700 | — | 790 | G | G | G |

-continued

| | | | | | | | | | |
|---|---|---|---|---|---|---|---|---|---|
| Comparative ingredients | 3-27 | 3V* | 1180 | 730 | — | 790 | P | P | P |
| | 3-28 | 3W* | 1190 | 760 | — | 780 | G | P | P |
| | 3-29 | 3X* | 1170 | 720 | — | 780 | G | P | P |
| | 3-30 | 3Y* | 1150 | 710 | 760 | — | P | P | P |
| | 3-31 | 3Z* | 1210 | 780 | 810 | — | P | P | P |
| | 3-32 | 3ZA* | 1180 | 760 | 810 | — | G | P | P |
| | 3-33 | 3ZB* | 1180 | 760 | 820 | — | P | G | G |
| | 3-34 | 3ZC* | 1180 | 760 | 820 | — | P | G | G |
| | 3-35 | 3ZD* | 1180 | 760 | 820 | — | P | G | G |
| | 3-36 | SUS410L | | | | | | P | P |
| | 3-37 | SUS430 | | | | | | G | G |

The invention claimed is:

1. A ferritic stainless steel sheet characterized by comprising, by mass %,

C: 0.022 to 0.3%,

Si: 0.01 to 1.0%,

Mn: 0.01 to 2.0%,

P: 0.005 to 0.05%,

S: 0.0001 to 0.02%,

Cr: over 13 to 22%,

N: 0.001 to 0.1%,

Al: 0.0001 to 1.0%,

Sn: 0.060 to 1.0%,

Mo: 0.01 to 0.30%, and a balance of Fe and unavoidable impurities, wherein a metal structure of the stainless steel sheet is a ferrite single phase, and wherein γp which is defined by the following formula (formula 2-2) satisfies the following formula (formula 2-1):

$$5 \leq \gamma p \leq 55 \quad \text{(formula 2-1)}$$

$$\gamma p = 420C + 470N + 23Ni + 7Mn + 9Cu - 11.5Cr - 11.5Si - 52Al - 57.5Sn + 189 \quad \text{(formula 2-2)}$$

wherein, each of C, N, Ni, Mn, Cu, Cr, Si, Al, and Sn in (formula 2-2) denotes the content of the element.

2. The ferritic stainless steel sheet according to claim 1 characterized by satisfying, instead of the formula (formula 2-1), the following formula (formula 2-1'):

$$10 \leq \gamma p \leq 40 \quad \text{(formula 2-1')}.$$

3. The ferritic stainless steel sheet according to claim 1 characterized by further comprising, by mass %, one or more elements of Mg: 0.005% or less, B: 0.005% or less, Ca: 0.005% or less, La: 0.1% or less, Y: 0.1% or less, Hf: 0.1% or less, and a REM: 0.1% or less.

4. The ferritic stainless steel sheet according to claim 2 characterized by further comprising, by mass %, one or more elements of Mg: 0.005% or less, B: 0.005% or less, Ca: 0.005% or less, La: 0.1% or less, Y: 0.1% or less, Hf: 0.1% or less, and a REM: 0.1% or less.

5. The ferritic stainless steel sheet according to claim 1 characterized by further comprising, by mass %, one or more elements of Nb: 0.3% or less, Ti: 0.3% or less, Ni: 1.0% or less, Cu: 1.0% or less, V: 1.0% or less, Zr: 0.5% or less, and Co: 0.5% or less.

6. The ferritic stainless steel sheet according to claim 2 characterized by further comprising, by mass %, one or more elements of Nb: 0.3% or less, Ti: 0.3% or less, Ni: 1.0% or less, Cu: 1.0% or less, V: 1.0% or less, Zr: 0.5% or less, and Co: 0.5% or less.

* * * * *